United States Patent [19]

Murray

[11] Patent Number: 4,685,167

[45] Date of Patent: Aug. 11, 1987

[54] MOP CONSTRUCTION

[75] Inventor: John H. Murray, LaGrange, Ga.

[73] Assignee: Milliken Research Corporation, Spartanburg, S.C.

[21] Appl. No.: 791,366

[22] Filed: Oct. 25, 1985

[51] Int. Cl.[4] ..... A47L 13/24

[52] U.S. Cl. ..... 15/228; 15/147 A; 15/147 B; 15/229 A

[58] Field of Search ..... 15/147 R, 147 A, 147 B, 15/228, 229 A, 229 AC, 229 AP, 229 B, 229 BC, 229 BP, 231, 233; 51/358

[56] References Cited

U.S. PATENT DOCUMENTS

| | | | |
|---|---|---|---|
| 3,528,120 | 9/1970 | Lindstrom | 15/228 |
| 3,737,938 | 6/1973 | Saltzstein | 15/231 |
| 3,792,505 | 2/1974 | Saltzstein | 15/231 |
| 3,843,993 | 10/1974 | Leland | 15/231 |
| 3,877,103 | 4/1975 | Nash | 15/231 X |
| 3,991,432 | 11/1976 | Griffin et al. | 15/229 BP |
| 3,996,639 | 12/1976 | Griffin et al. | 15/229 B |

*Primary Examiner*—Edward L. Roberts

*Attorney, Agent, or Firm*—Earle R. Marden; H. William Petry

[57] ABSTRACT

An improved dust mop with a strip of material attached thereto having loops on the underside thereof to engage a strip of material with hooks thereon. The strip of material with hooks is mounted on top of a mop holder and the strip of looped material engages same to securely hold the dust mop to the mop holder.

13 Claims, 1 Drawing Figure

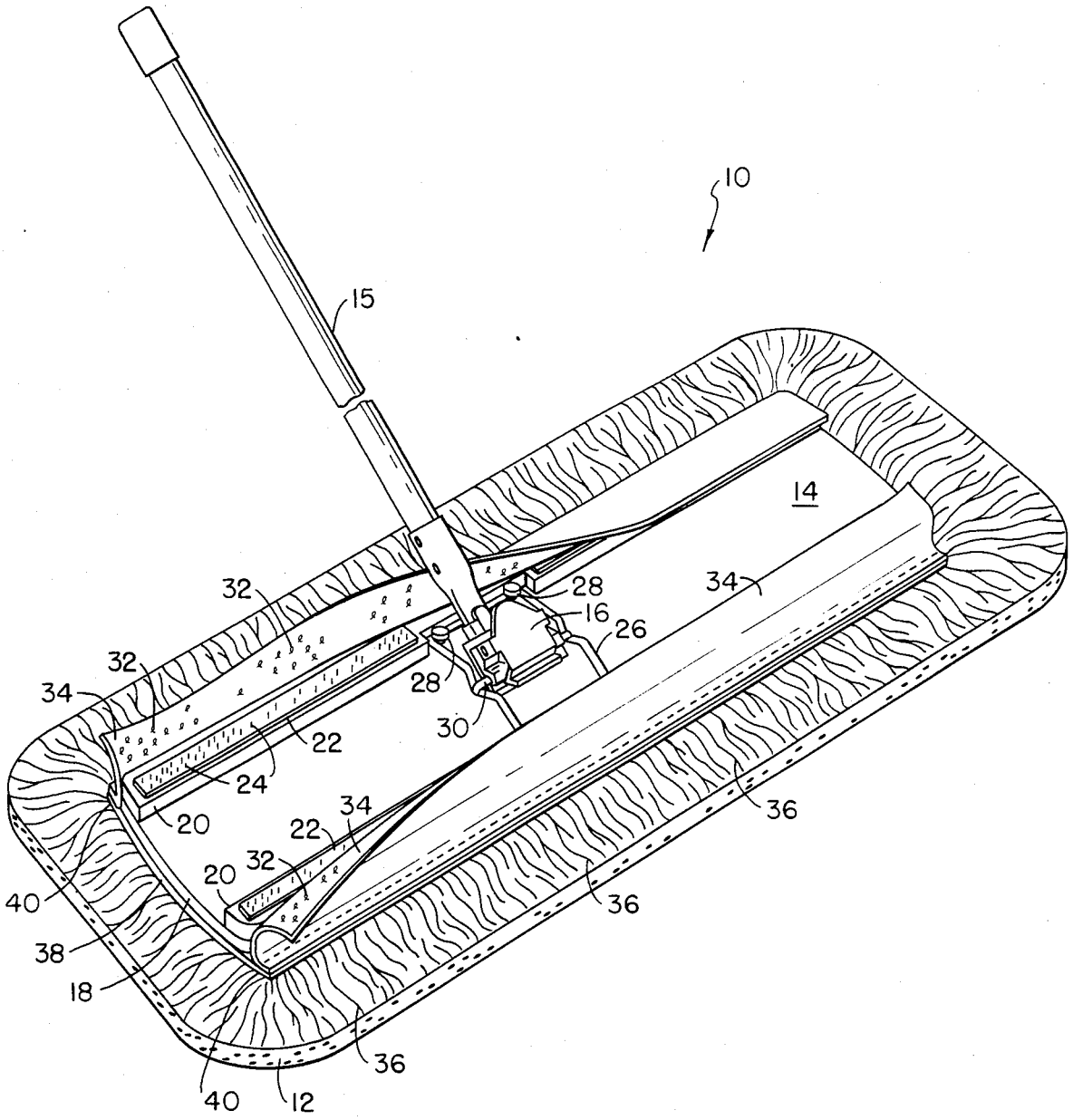
10
15
14
32
32
34
28
16
26
34
28
30
22
24
20
34
22
32
20
40
38
18
36
36
40
12

MOP CONSTRUCTION

This invention relates generally to a new and improved dust mop and dust mop head which can be readily engaged and disengaged to provide ease of replacement and cleaning of the dust mop when required.

The object of the invention is to provide a mop and mop head construction which will allow easy engagement and disengagement of the mop to and from the mop head.

Other objects of the invention will become readily apparent as the specification proceeds to describe the invention with reference to the accompanying drawing in which the new and improved mop and mop head are shown in perspective.

The new and improved mop construction 10 consists of a mop 12, a mop holder 14 and a mop handle 15. The mop handle 15 with its clamping member 16 is generally of the type disclosed in U.S. Pat. No. 3,029,454 and is not, per se, part of the invention.

The mop holder 14 consists of a substantially flat, rectangular base member 18 of wood, plastic, metal or other suitable material; upstanding flange member 20, either integral or separate from the base member; strips of material 22 with upstanding hook members 24 mounted on top of the flange member 20 and a wire mop handle support member 26 mounted centrally of the base member 18.

The wire mop handle support member 26 is secured to the base member 18 by screws 28 at the four corners or by other suitable means and has a rod 30 extending between the side wall thereof for grasping by the clamping member 16 in the manner disclosed in U.S. Pat. No. 3,029,454, supra.

The strip or fastening member 22 can be of any suitable type such as that described in U.S. Pat. No. 3,009,235, and sold under the trademark VELCRO so long as it has the upstanding hook members for engagement of by the loops 32 of the elongated strip of material 34 sewn or otherwise secured to the mop 12.

In the preferred form of the invention, the mop 12 is a dry mop for dusting purposes but obviously a wet mop could be employed within the scope of the invention. The mop 12 is a standard mop having cotton yarns 36 tufted through a suitable backing 38 to provide a dusting surface. The backing 38 preferably is wider than the mop head backing to provide an area 40 to which the elongated strips of material 34 can be sewn. In the preferred form of the invention, the material 34 is a warp knit, weft inserted polyester fabric with the laps of the knit structure providing the loops 32 which are engaged by the hooks 24. This fabric is fully described in co-pending U.S. patent application Ser. No. 720,953, filed Apr. 8, 1985. If desired, instead of using the above-described loop fabric, a standard VELCRO loop fabric can be used.

It can be seen that a mop construction has been provided which allows ready removal of the mop 12 from the mop holder 14 without having to touch the soiled mop since the loop 32 and hook 24 arrangement is on the top of the mop frame and is readily accessible. Furthermore, the loop and hook fastener arrangement is in a protected position since it is not exposed to the surface being cleaned and does not tend to pick up ambient lint and dirt. Also, with the loop and hook arrangement on the top of the mop construction, it is much easier to provide a tight fit between the mop and the mop holder. Another big advantage is that the tendency of the mop to shrink during washing thereof does not effect the fit of the mop on the mop frame due to the hook and loop fastening means.

Although the preferred embodiment of the invention has been described, it is contemplated that many changes may be made without departing from the scope or spirit of the invention and I desire to be limited only by the claims.

I claim:

1. An improved mop construction comprising: a mop head, said mop head being substantially flat on one side thereof, said mop head having means on the other side thereof to accomodate a mop handle, said mop head having a plurality of fastening strips mounted thereon on the side thereof opposite to said substantially flat side, said fastening strips being provided with a plurality of closely spaced interengageable hooks, and a mop having its backing substantially flush with the flat side of said mop head and having elongated fastening strips connected thereto, said elongated strips having a plurality of loop members thereon, said fastening strips on said mop being wrapped around the edge of said mop head and having its loop members in engagement with the hook members on top of said mop head.

2. The mop construction of claim 1 wherein said fastening strips on said mop are strips of warp knit, weft inserted fabrics having lap loops.

3. The mop of claim 2 wherein said fastening strips with loops are substantially 100% polyester fabrics.

4. The mop construction of claim 1 wherein the backing of the mop extends outwardly of said mop head and said fastening strips thereon are connected to that portion of the backing extending beyond said mop head.

5. The mop construction of claim 4 wherein said fastening strips on said mop are strips of warp knit, weft inserted fabrics having lap hooks.

6. The mop of claim 5 wherein said fastening strips with loops are substantially 100% polyester fabrics.

7. The mop construction of claim 1 wherein the surface of said mop head on the side opposite to said flat surface is raised adjacent to at least two edges thereof, said fastening strips with hooks thereon being connected to said raised surfaces.

8. The mop construction of claim 7 wherein the backing of the mop extends outwardly of said mop head and said fastening strips thereon are connected to that portion of the backing extending beyond said mop head.

9. The mop construction of claim 8 wherein said fastening strips on said mop are strips of warp knit, weft inserted fabrics having lap hooks.

10. The mop of claim 9 wherein said fastening strips with loops are substantially 100% polyester fabrics.

11. A mop for a mop arrangement comprising: a substantially rectangular backing material having one side longer than a second side, a plurality of yarns extending outwardly from the bottom of said backing material and an elongated fastening strip connected along an edge thereof to the top side of the backing material adjacent to and extending along the long side thereof, said fastening strip having a plurality of hook engaging loops on the bottom side thereof facing the top of said backing material.

12. The mop of claim 11 wherein said fastening strip is a warp knit weft inserted fabric having lap loops, said lap loops being said hook engaging loops.

13. The mop of claim 12 wherein said fastening strip is substantially 100% polyester.

* * * * *